US009325057B2

(12) United States Patent
Katipally et al.

(10) Patent No.: US 9,325,057 B2
(45) Date of Patent: Apr. 26, 2016

(54) ANTENNA RADIATING ELEMENT

(75) Inventors: Raja R. Katipally, Cheshire, CT (US); Andrzej E. Stanek, New Haven, CT (US); Powell M. Chuck, Vernon, CT (US)

(73) Assignee: Alcatel Lucent, Boulogne-Billancourt (FR)

( * ) Notice: Subject to any disclaimer, the term of this patent is extended or adjusted under 35 U.S.C. 154(b) by 631 days.

(21) Appl. No.: 13/287,598

(22) Filed: Nov. 2, 2011

(65) Prior Publication Data

US 2013/0106668 A1 May 2, 2013

(51) Int. Cl.

| | |
|---|---|
| ***H01Q 21/26*** | (2006.01) |
| ***H01Q 1/24*** | (2006.01) |
| ***H01Q 19/10*** | (2006.01) |
| ***H01Q 21/24*** | (2006.01) |

(52) U.S. Cl.

CPC ..... *H01Q 1/246* (2013.01); *H01Q 19/10* (2013.01); *H01Q 21/24* (2013.01); *Y10T 29/49016* (2015.01)

(58) Field of Classification Search

USPC ..... 343/786, 797, 840, 793

See application file for complete search history.

(56) References Cited

U.S. PATENT DOCUMENTS

| | | | | |
|---|---|---|---|---|
| 3,740,754 | A * | 6/1973 | Epis | 343/797 |
| 4,183,027 | A | 1/1980 | Ehrenspeck | |
| 5,874,924 | A * | 2/1999 | Csongor et al. | 343/797 |
| 6,747,606 | B2 | 6/2004 | Harel et al. | |
| 8,004,474 | B2 * | 8/2011 | Makarov et al. | 343/909 |
| 8,269,686 | B2 * | 9/2012 | Johnston et al. | 343/797 |
| 2003/0222830 | A1 | 12/2003 | Harel et al. | |
| 2006/0109193 | A1 | 5/2006 | Williams | |
| 2010/0149062 | A1 * | 6/2010 | Baldauf | 343/797 |
| 2010/0283707 | A1 | 11/2010 | Foo | |

FOREIGN PATENT DOCUMENTS

| | | | |
|---|---|---|---|
| CN | 2505992 | Y | 8/2002 |
| CN | 2831463 | Y | 10/2006 |
| EP | 1152487 | A1 | 11/2001 |
| EP | 1367672 | A1 | 12/2003 |
| EP | 1667278 | A1 | 6/2006 |

OTHER PUBLICATIONS

International Search Report (PCT/ISA/210) for International Application No. PCT/US2012/061784 dated Jan. 31, 2013.

Written Opinion of the International Searching Authority (PCT/ISA/237) for International Application No. PCT/US2012/061784 dated Jan. 31, 2013.

International Preliminary Report on Patentability (PCT/ISA/237) for International Application No. PCT/US2012/061784 dated May 15, 2014.

Chinese Office Action dated Dec. 22, 2014 in corresponding Chinese Application No. 201280053917.7.

* cited by examiner

*Primary Examiner* — Tan Ho

(74) *Attorney, Agent, or Firm* — Harness, Dickey & Pierce, P.L.C.

(57) ABSTRACT

The antenna radiating element includes an antenna configured to transmit a signal having one or more measurable characteristics and a shroud surrounding the antenna and configured to change the one or more measurable characteristics.

20 Claims, 9 Drawing Sheets

ANTENNA RADIATING ELEMENT

BACKGROUND OF THE INVENTION

1. Field

Embodiments relate to base-station antennae for use in mobile communication systems.

2. Related Art

Dipole antennae are common in the communications industry, and conventional structures, including half-wavelength dipoles with "bow tie" structures and "butterfly" structures, are described in several known publications.

In particular, panel base-station antennae, such as those used in mobile communication systems, rely heavily on dual polarization antennae. In many cases, these antennae are constructed using single linear polarized elements, grouped in such a way that creates dual polarization. In this case, two separate arrays of radiating elements are required to radiate on both polarizations.

Building antenna using this approach is undesirable, however, because creating the dual polarization effect with single linear polarized elements increases the labor cost and the number of parts involved in the antenna's manufacture, while reducing its overall performance. To overcome this, most dual polarization antennae are made with directly dual polarized elements, either by including a single patch element fed in such a manner as to create a dual polarized structure, or by combining two single linear polarized dipoles into one, thereby making a single, dual polarization element.

Feeding signals to and from these dual polarization structures is usually accomplished by conventional coupling structures such as coaxial cables, microstrip or stripline transmission lines, or slits. The drawback to using these conventional coupling structures with the antennae and dipoles described above is that they increase the number of parts needed to construct the antenna, thereby generating undesired intermodulation distortions.

In addition, manufacturing these panel antennae with dipoles that include numerous radiating elements often requires numerous solder joints and screw connections. The total number of parts required in such panel antennae, in addition to the cost of their assembly, makes them unsuitable for mass-production. In addition, solder, screws, and similar types of attachments between parts not only add to the manufacturing time and labor cost, but also generate undesired intermodulation distortions as well.

In addition to avoiding these intermodulation distortions, it is also desirable to achieve good port-to-port isolation between the two inputs of the radiating elements in the antenna in order to achieve an efficient communication system. This isolation is the measure of the ratio of power leaving one port and entering the other port. But using the air dielectric transmission lines that are common in conventional coupling structures creates distortions in the signal fed to and from the reflector. In these circumstances, it is prohibitively expensive and difficult to achieve the desired isolation, meaning that the antenna cannot be configured such that one port is used for transmission and the other port for reception.

Finally, in addition to having good port-to-port isolation characteristics and a minimum of intermodulation distortions, it is also desirable for the dipoles in the antenna array to have a good impedance so that all of the dipoles in the array can be properly matched.

In conventional antennas (e.g., butter fly design antennas and Four Square dipole elements), regular dipole antennas have issues with cross polarization and isolation between the same band elements and different bands for multi band and higher beam width antennas. Minimizing cross polarization and isolation using conventional techniques are expensive and time consuming. Further, development procedures and production of conventional antennas is expensive.

SUMMARY OF THE INVENTION

Example embodiments provide a system and a method to provide improved beam widths for an antenna based on a shroud or baffle design.

One embodiment includes an antenna radiating element. The antenna radiating element includes an antenna configured to transmit a signal having one or more measurable characteristics and a shroud surrounding the antenna and configured to change the one or more measurable characteristics.

One embodiment includes a method of manufacturing an antenna shroud. The method includes modeling an antenna, the model including one or more measurable signal characteristics, modeling the shroud to change the one or more measurable signaling characteristics, and manufacturing the shroud.

One embodiment includes a method of changing signal characteristics of an antenna. The method includes installing a shroud over an antenna, wherein the shroud changes one or more measurable signal characteristics associated with the antenna

BRIEF DESCRIPTION OF THE DRAWINGS

The present invention will become more fully understood from the detailed description given herein below and the accompanying drawings, wherein like elements are represented by like reference numerals, which are given by way of illustration only and thus are not limiting of the present invention and wherein.

Figure 1:
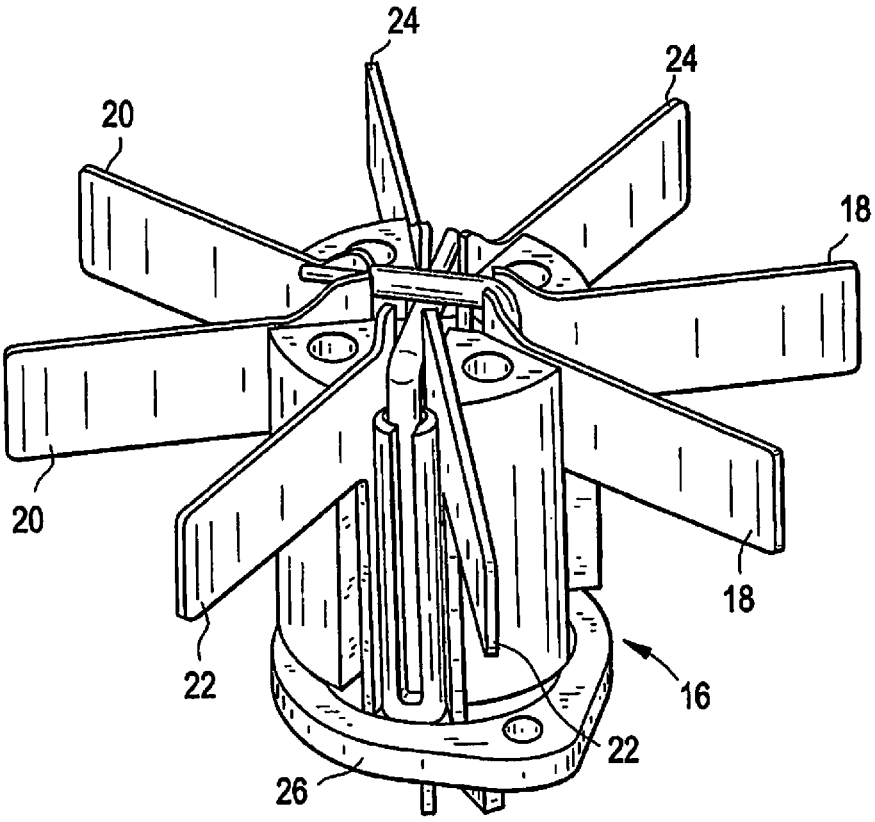
CONVENTIONAL ART FIG. 1
FIG. 1 illustrates a perspective view of a dual polarization dipole antenna.

It should be noted that these Figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. For example, the relative thicknesses and positioning of molecules, layers, regions and/or structural elements may be reduced or exaggerated for clarity. The use of similar or identical reference numbers in the various drawings is intended to indicate the presence of a similar or identical element or feature.

DETAILED DESCRIPTION OF THE EMBODIMENTS

While example embodiments are capable of various modifications and alternative forms, embodiments thereof are shown by way of example in the drawings and will herein be described in detail. It should be understood, however, that there is no intent to limit example embodiments to the particular forms disclosed, but on the contrary, example embodiments are to cover all modifications, equivalents, and alternatives falling within the scope of the claims. Like numbers refer to like elements throughout the description of the figures.

Before discussing example embodiments in more detail, it is noted that some example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

It should also be noted that in some alternative implementations, the functions/acts noted may occur out of the order noted in the figures. For example, two figures shown in succession may in fact be executed concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

As used herein, the term "mobile unit" may be considered synonymous to, and may hereafter be occasionally referred to, as a client, user equipment, mobile station, mobile user, mobile, subscriber, user, remote station, access terminal, receiver, etc., and may describe a remote user of wireless resources in a wireless communication network.

Similarly, as used herein, the term "base station" or "eNodeB" may be considered synonymous to, and may hereafter be occasionally referred to, as a Node B, evolved Node B, base transceiver station (BTS), etc., and may describe a transceiver in communication with and providing wireless resources to mobiles in a wireless communication network which may span multiple technology generations. As discussed herein, base stations may have all functionally associated with conventional, well-known base stations in addition to the capability to perform the methods discussed herein.

Figure 2:
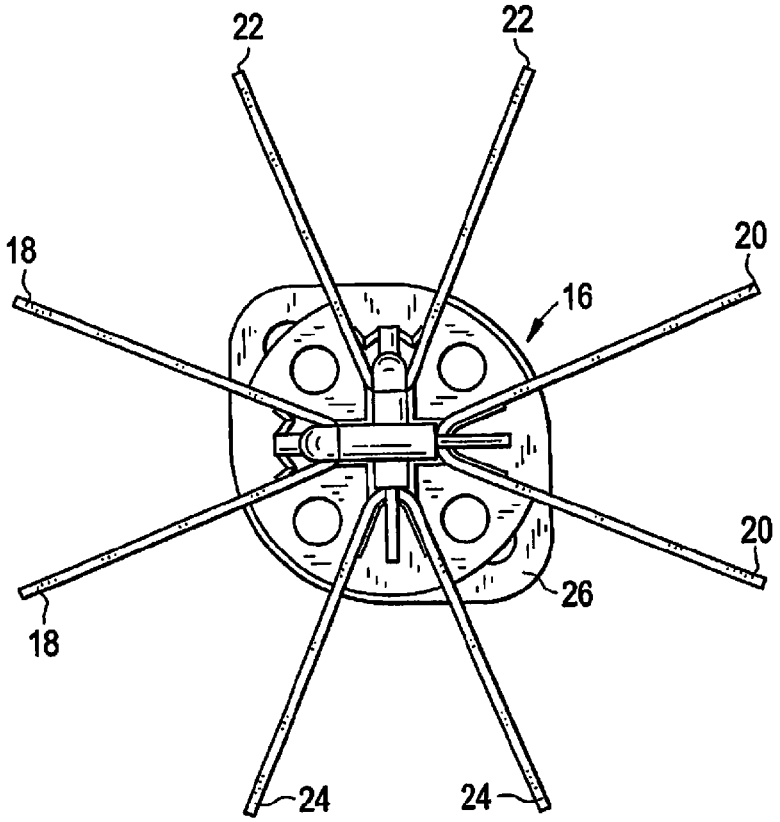
CONVENTIONAL ART FIG. 2
FIG. 2 illustrates a top view of the dual polarization dipole antenna illustrated in FIG. 1.

FIGS. 1 and 2 illustrate a side and top view of a dipole antenna 16. The dipole antenna 16 is constructed as a unitary structure including the base portion, arms, and feeding structures discussed below. The construction of the dipole may be accomplished by conventional methods, such as molding, casting, or carving. In addition, the dipole may be constructed using conventional materials such as copper, bronze, plastic, aluminum, or zamak. If the material used is a type that cannot be soldered, such as plastic or aluminum, then the dipole, once formed, may be covered or plated, in part or in whole, with a metallic material that can be soldered, such as copper, silver, or gold.

The dipole antenna 16 includes four pairs of arms 18, 20, 22, and 24 attached to a base portion 26. The arms are arranged in pairs 18, 20, 22, and 24 each having a V- or U-shape, with the arms radiating outward from the vertex portion 21 of the V or U. The base portion 26 of the dipole attaches to, for example a known reflector plate (not shown).

The pairs of arms are arranged such that pair 18 is opposite pair 20, and pair 22 is opposite pair 24. The opposing pairs are wired and positioned with respect to the base portion 26 (and the reflector plate) so as to transmit and/or receive RF energy at two polarizations: a first polarization of +45 degrees and a second polarization of −45 degrees with respect to the base portion 26. Opposing pairs 20 and 18 correspond to the first and second polarization of the dipole antenna 16, respectively. Likewise, opposing pairs 24 and 22 correspond to the first and second polarizations. The dipole according to example embodiments is not limited to these polarizations, and it is understood that changing the number, arrangement and position of the arm pairs may change both the number of polarizations and the polarization angles of the antenna.

It is understood that the molded dipole according to example embodiments may be used in a variety of antenna configurations. Furthermore, the base portion 26 of the molded dipole can be designed and shaped to match a complimentary form on a reflector plate so as to further facilitate the assembly of the antenna array. It would be obvious to one skilled in the art that the size and shape of the base portion can vary from antenna to antenna and still be within the scope of the invention.

Figure 3A:
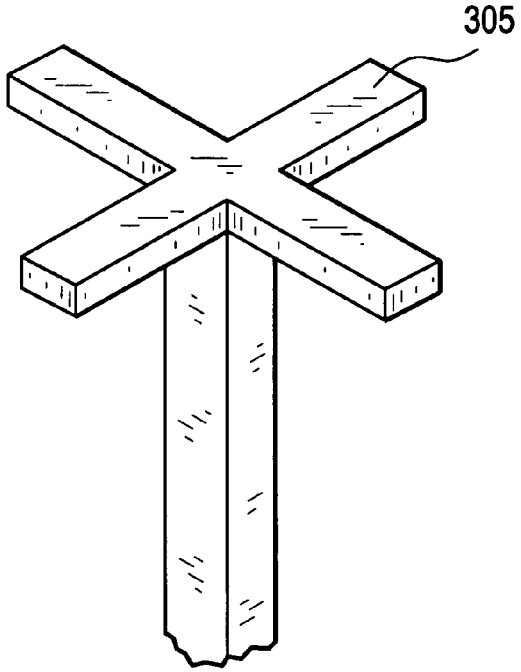
FIGS. 3A and 3B illustrate simplified dipole antennae according to example embodiments.
Figure 3B:
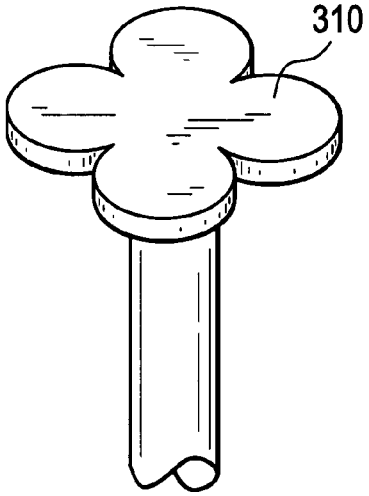

FIGS. 3A and 3B illustrate simplified dipole antennae according to example embodiments. FIG. 3A illustrates a dipole antenna 305 including straight (V-shaped) arm elements and FIG. 3B illustrates a dipole antenna 310 including semi-circular (U-Shaped) arm elements. The arm elements may be, for example, arms 18, 20, 22, and 24 attached to a base portion 26 as illustrated in more detail above with regard to FIG. 1. As one skilled in the art will appreciate, the simplified dipole antennae as illustrated in FIGS. 3A and 3B are only two examples of a plurality of dipole antennae.

Figure 4A:
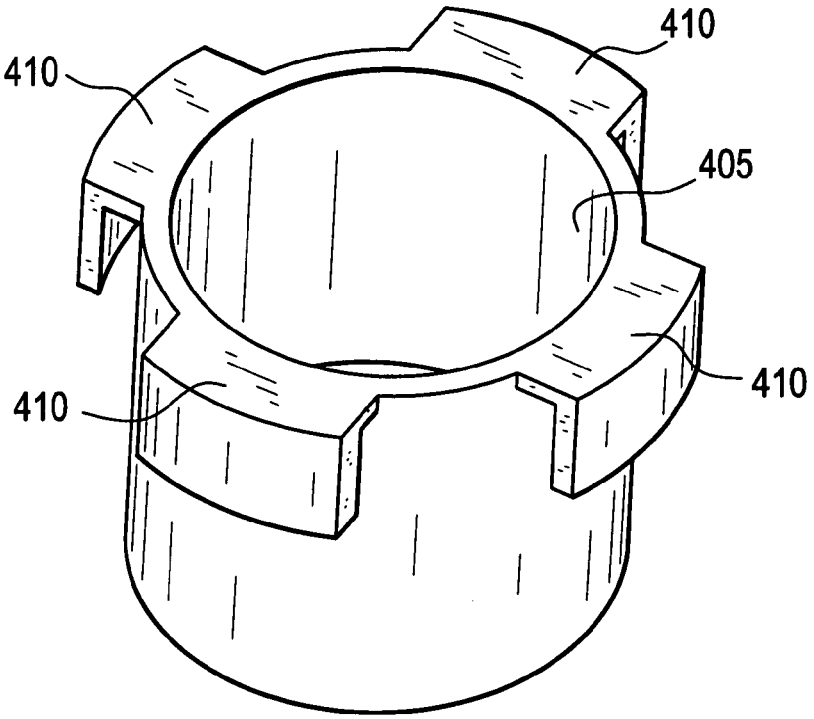
FIGS. 4A-4C illustrate antenna shrouds or baffles according to example embodiments.
Figure 4B:
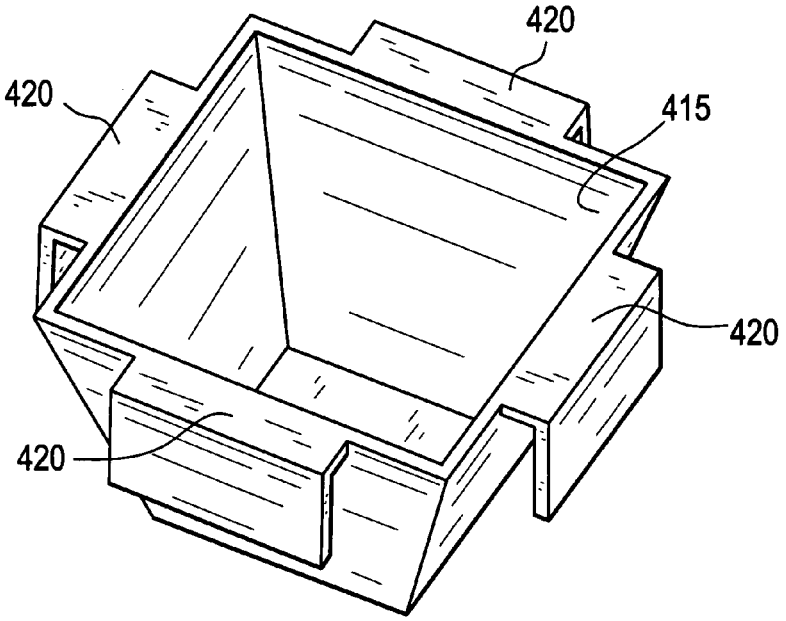
Figure 4C:
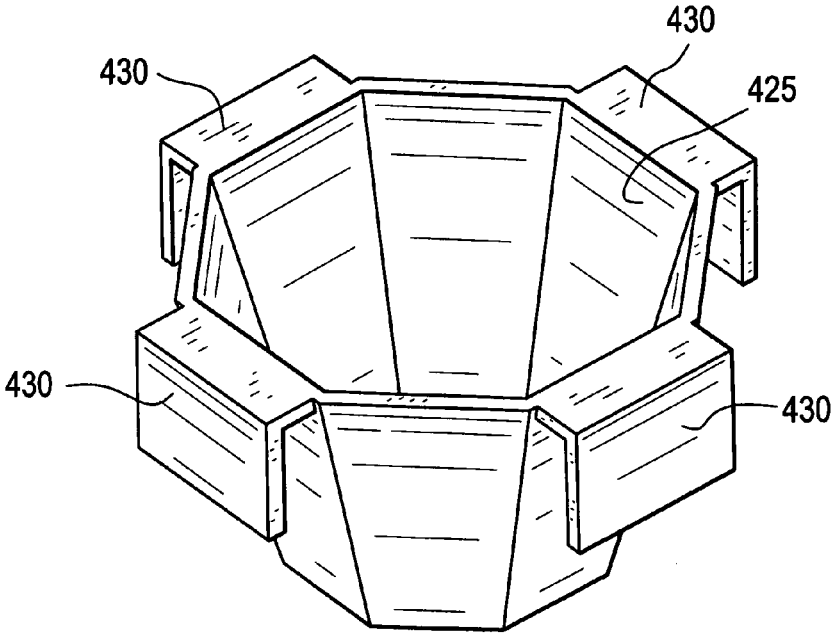

FIGS. 4A-4C illustrate antenna shrouds or baffles according to example embodiments. FIG. 4A shows a baffle including a hollow body or channel 405 and four members or wings 410. The hollow body may be a cylinder as shown by hollow body 405. FIG. 4B shows a baffle including a square (or rectangular) cross-section hollow body 415 and four members or wings 420. FIG. 4C shows a baffle including an octagon cross-section hollow body 425 and four members or wings 430. As one skilled in the art will appreciate, the antenna shrouds or baffles as illustrated in FIGS. 4A-4C are only examples of a plurality of antenna shrouds or baffles. The shapes of the bodies (e.g., cylinder hollow body 405, square (or rectangular) cross-section hollow body 415 and octagon cross-section hollow body 425) are not limited to the shapes illustrated in FIGS. 4A-4C. For example, the shape of the hollow body may be an oval cross-section or a hexagon cross-section or the like. Further, although only four members or wings 410, 420, 430 are shown, one skilled in the art will appreciate that the number of members or wings 410, 420, 430 may be less than or greater than four as well.

The baffle bodies 405, 415, 425 may be tapered from one end to the other. The walls of baffle bodies 405, 415, 425 may be of varying thicknesses or structure. For example, one hollow body wall may be smooth while another includes ripples.

The members or wings 410, 420, 430 may be of varying designs as well. For example, the illustrated members or wings 410, 420, 430 are L shaped members with a perpendicular portion projecting perpendicularly from a surface of the shroud or baffle body and a parallel portion extending down from the perpendicular portion and parallel to the shroud or baffle body. The illustrated members or wings 410, 420, 430 are shown with substantially similar lengths and widths associated with each of the parallel and perpendicular portions. However, the parallel portion may have a shorter or longer length as compared to the perpendicular portion. In addition, the parallel and perpendicular portion may have different and/or varying widths from one another.

The parallel and perpendicular portions may be different shapes, e.g., circles or semi-circles. Further, the perpendicular portion may be attached to the shroud or baffle body at some other angle. In addition, the parallel portion may have some other relation to the shroud or baffle body. For example, the parallel portion may angle in towards the shroud or baffle body. Still further, the members or wings 410, 420, 430, or some portions thereof, may be slotted or patterned.

The members or wings 410, 420, 430, or some portions thereof, may be constructed of the same material or, alternatively, a different material as the shroud or baffle body. The members or wings 410, 420, 430 and the shroud or baffle body may be constructed of, for example, copper, bronze, plastic, aluminum, zamak, other conventional materials or combinations thereof. If the material used is a non-conductive material or minimally conductive material, such as plastic or aluminum, then the shroud or baffle body and/or the members or wings 410, 420, 430 may be loaded, covered or plated, in part or in whole, with a conductive material, such as copper, silver, or gold.

Figure 5A:
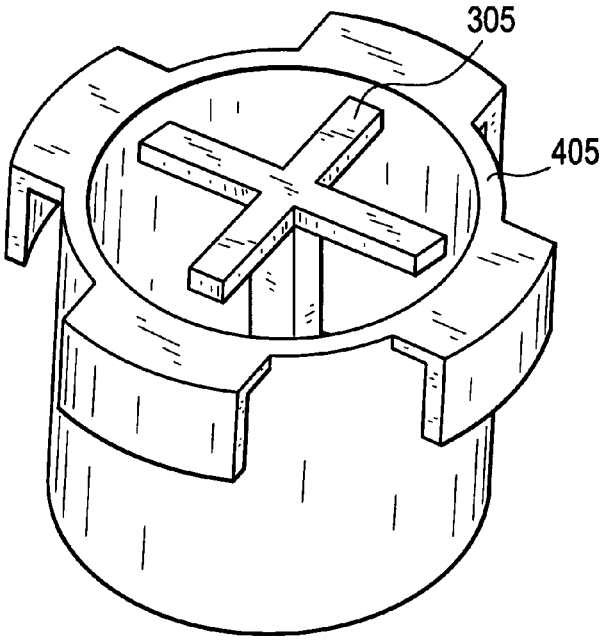
FIGS. 5A-5C illustrates antenna/antenna shroud systems according to example embodiments.
Figure 5B:
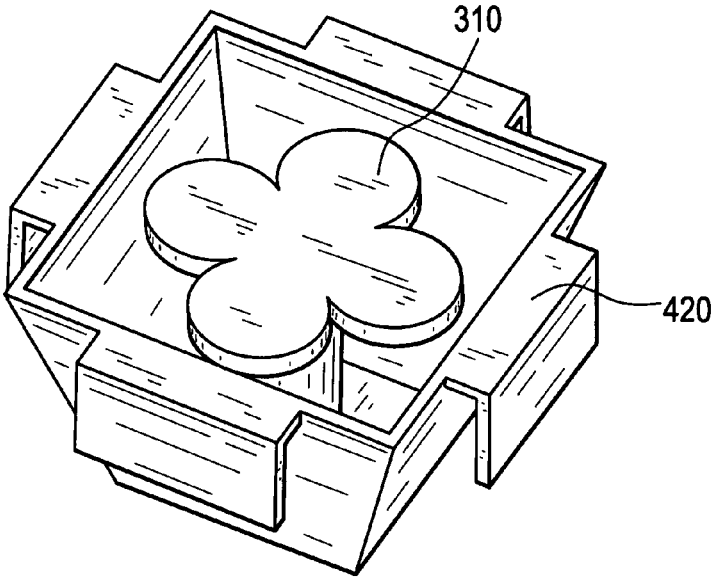
Figure 5C:
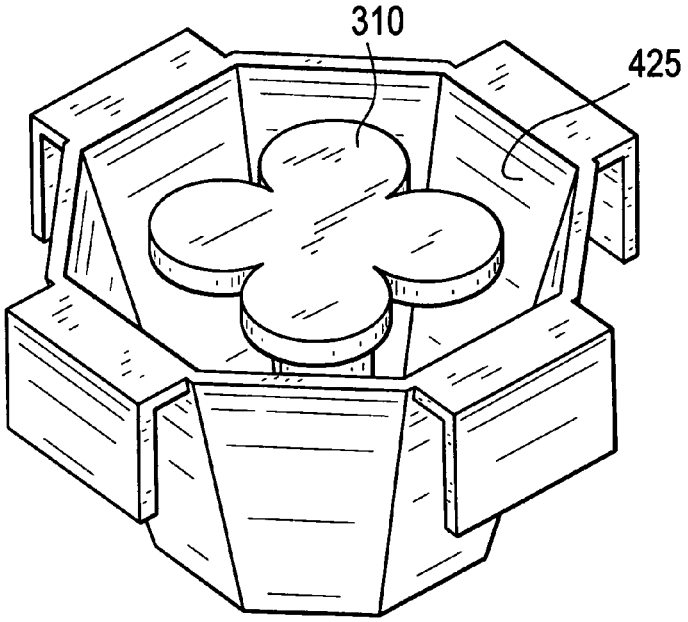

FIGS. 5A-5C illustrate alternative examples of antenna/antenna shroud systems according to example embodiments. FIG. 5A illustrates the dipole antenna 305 within the shroud or baffle 405. FIG. 5A shows the dipole antenna 305 which includes straight (V-shaped) arm elements (as shown in FIG. 3A). However, one skilled in the art will appreciate that FIG. 5A is not limited thereto. For example, the dipole antenna 305 may be a dipole antenna including semi-circular (U-Shaped) arm elements (e.g., dipole antenna 310 as shown in FIG. 3B).

FIG. 5A shows the shroud or baffle 405 which is the cylinder hollow body and four members or wings as shown in FIG. 4A. However, one skilled in the art will appreciate that FIG. 5A is not limited thereto. For example, the shroud or baffle 405 may be a shroud or baffle including a square (or rectangular) cross-section hollow body (e.g., shroud or baffle 415 as shown in FIG. 4B).

FIG. 5B illustrates the dipole antenna 310 within the shroud or baffle 420. FIG. 5B shows the dipole antenna 310 includes straight (U-shaped) arm elements (as shown in FIG. 3B). However, one skilled in the art will appreciate that FIG. 5B is not limited thereto. For example, the dipole antenna 310 may be a dipole antenna including semi-circular (V-Shaped) arm elements (e.g., dipole antenna 305 as shown in FIG. 3A).

FIG. 5B shows the shroud or baffle 420 which is the square (or rectangular) cross-section hollow body and four members or wings (as shown in FIG. 4B). However, one skilled in the art will appreciate that FIG. 5B is not limited thereto. For example, the shroud or baffle 420 may be a shroud or baffle including a cylinder hollow body (e.g., shroud or baffle 405 as shown in FIG. 4A).

FIG. 5C illustrates a dipole antenna 310 within a shroud or baffle 425. FIG. 5C shows the dipole antenna 310 is the straight (U-shaped) arm elements (as shown in FIG. 3B). However, one skilled in the art will appreciate that FIG. 5C is not limited thereto. For example, the dipole antenna 310 may be a dipole antenna including semi-circular (V-Shaped) arm elements (e.g., dipole antenna 305 as shown in FIG. 3A).

FIG. 5C shows the shroud or baffle 425 which is the octagon cross-section hollow body and four members or wings (as shown in FIG. 4C). However, one skilled in the art will appreciate that FIG. 5C is not limited thereto. For example, the shroud or baffle 425 may be a shroud or baffle including a cylinder hollow body (shroud or baffle 405 as shown in FIG. 4A).

The antenna/antenna shroud systems are configured such that the beam width of the antenna, Isolation and cross polarization may be optimized in, for example, a multi band antenna platform. For example, cross polarization may be minimized. For example, when integrating 900 MHz bands into the Personal Communication Services/Digital Cellular System (PCS/DCS) bands (e.g., 1800/1900 MHz) mutual coupling may occur for wider beam width antennas. By adding the shroud or baffle (e.g., 405, 415 or 425 as illustrated in FIGS. 4A-5C) to the radiating elements (e.g., antennas 305, 310), the beam width may be controlled more accurately. Designing different beam width antennas by modifying the shroud or baffle design without changing the antenna may be possible.

For example, as discussed above, a dimension, a shape, an angular relationship or a material associated with the four members or wings 410 may change the beam width of the antenna. For example, a width, a thickness, a shape or a material of the four members or wings may be changed to optimize the beam width of the antenna. In addition, a radius of the cylinder hollow body 405 or length of a side associated with the square (or rectangular) cross-section hollow body 415 or octagon cross-section hollow body 425 may be changed to minimize cross polarization.

The configuration of the shroud or baffle (e.g., shroud or baffle illustrated in FIGS. 4A-4C) is a design time choice based on the antenna configuration (e.g., the antenna configuration illustrated in FIGS. 1-3B). For example, the antenna, which is typically already in use, and the shroud or baffle are modeled using a known 3D computer aided drafting (CAD) software. The models are merged together to generate a system as illustrated in FIGS. 5A-5C. Parameters associated with the merged model are then ported to a known 3D Full-wave Electromagnetic Field Simulation software. A transmission signal is simulated on the antenna and the simulation software generates a magnetic field result or simulated beam. The simulated beam is analyzed for, for example, a desired beam width of the antenna, isolation and cross polarization.

The shroud or baffle model is modified and the simulation is rerun resulting in a revised simulated beam. The simulation and modification of the shroud or baffle model is repeated until the desired beam width of the antenna, isolation and cross polarization is achieved. The shroud or baffle model may be modified such that materials (e.g., different metals, plated plastic, loaded plastic or the like) are changed, dimensions (e.g., width, diameter, number of members or wings, dimensions of the members or wings) are changed, shroud or baffle body style is changed.

Figure 6:
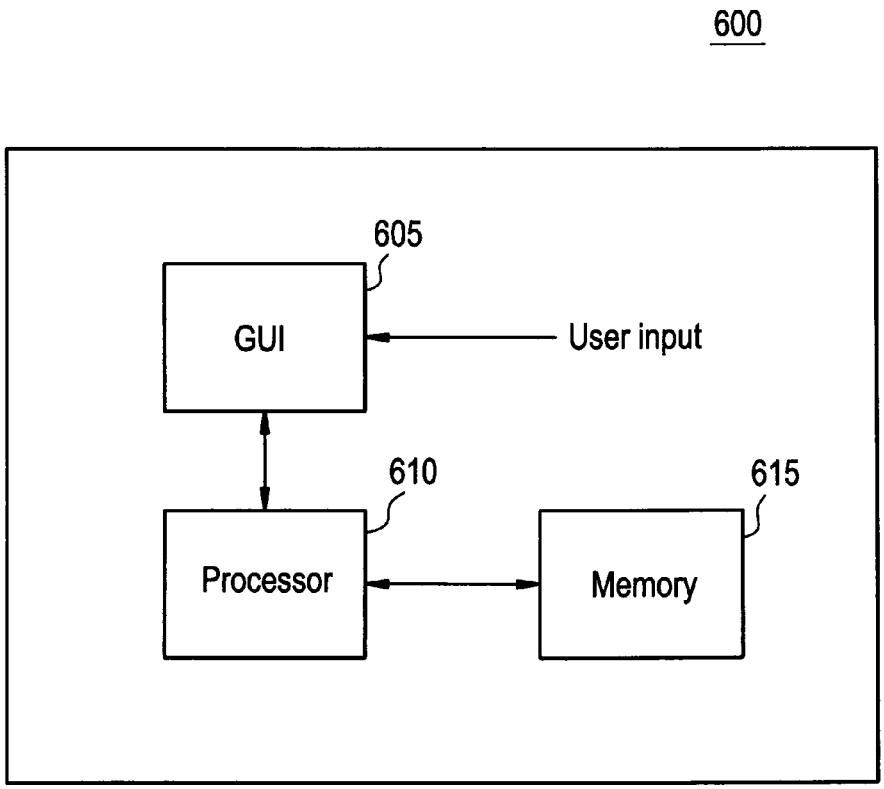
FIG. 6 illustrates a system for implementing a method of designing an antenna shroud system according to an example embodiment.

FIG. 6 illustrates a system 600 for implementing a method of designing an antenna shroud system according to at least one example embodiment. The system includes a graphical user interface (GUI) 605, a processor 610 and a memory 615. The system 600 may be a workstation, a server, a personal computer, or the like. The GUI may take a user input from, for example, a keyboard or a mouse.

Figure 7:
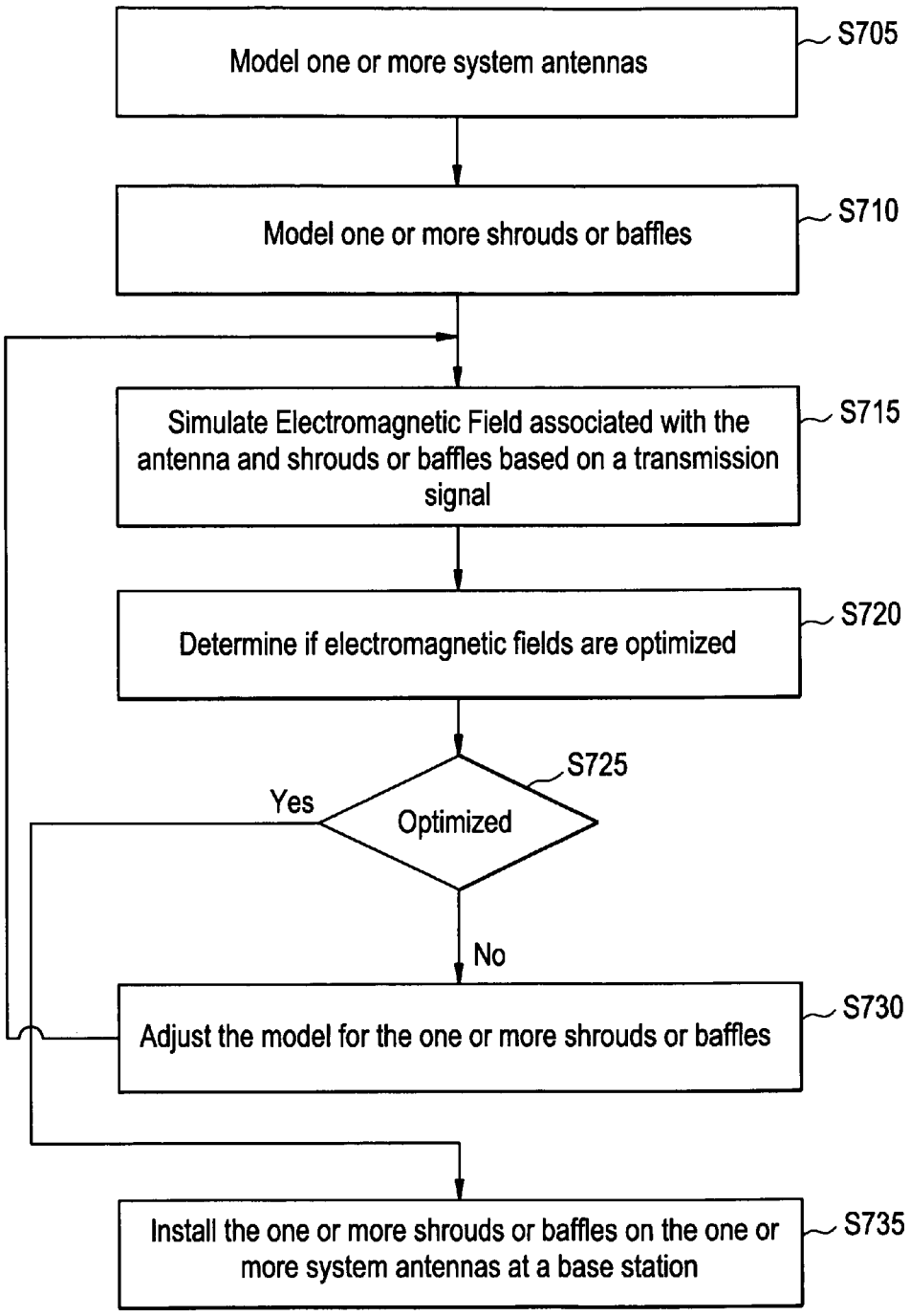
FIG. 7 illustrates a method of assembling an antenna/antenna shroud system according to an example embodiment.

FIG. 7 illustrates a method of assembling an antenna/antenna shroud system according to example embodiments. Referring to FIG. 7, in step S705 one or more system antennas is modeled by a processor (e.g., processor 610). For example, as described above, the one or more system antennas may be modeled using a known 3D computer aided drafting (CAD) software. The CAD software may be stored in memory 615, executed by processor 610 and use GUI 605 for user input.

In step S710 the processor models the shroud or baffle. For example, the shroud or baffle may be modeled using a known 3D computer aided drafting (CAD) software. Modeling using CAD software is known to those skilled in the art and will not be discussed further for the sake of brevity. The CAD software may be stored in memory 615, executed by processor 610 and use GUI 605 for user input.

In step S715 the processor simulates an electromagnetic field associated with the antenna and the shroud or baffle based on a transmission signal. For example, as described above, the CAD models are merged together to generate a system as illustrated in, for example, FIGS. 5A-5C. Parameters associated with the merged model are then ported to a known 3D Full-wave Electromagnetic Field Simulation software. A transmission signal is simulated on the antenna and the simulation software generates a magnetic field result or simulated beam. Simulating using simulation software is known to those skilled in the art and will not be discussed further for the sake of brevity. The 3D Full-wave Electromagnetic Field Simulation software may be stored in memory 615, executed by processor 610 and use GUI 605 for user input.

In step S720 the processor determines if the electromagnetic fields are optimized. For example, as discussed above, the simulated beam is analyzed for, for example, a desired beam width of the antenna, isolation and cross polarization. If in step S725 it is determined that the electromagnetic fields are not optimized, processing continues to step S730. Otherwise, processing moves to step S735.

In step S730 a designer adjusts the model for the one or more shrouds or baffles and processing returns to step S715. Alternatively, the processor adjusts the model based on criteria previously entered by the designer. For example, the shroud or baffle model may be adjusted, using the CAD software, such that materials (e.g., different metals, plated plastic, conductive material loaded plastic or the like) are changed, dimensions (e.g., width, diameter, number of members or wings, dimensions of the members or wings) are changed, shroud or baffle body style is changed.

In step S735 the one or more shrouds or baffles may be installed on the one or more system antennas at, for example, a base station. For example, one or more shrouds may be manufactured based on the final model for the one or more shrouds. The manufactured shrouds may be installed over one or more system antennas at, for example, a base station. One or more signal characteristics (e.g., beam width of the antenna, isolation and cross polarization) may be measured before and after the shroud is installed.

Example embodiments provide improved beam widths by the shroud or baffle design alone. The beam width stability may be adjusted by modifying the shroud or baffle design without changing the antenna. The isolation between, for example, +45 to −45 polarizations may be improved over conventional designs.

While example embodiments have been particularly shown and described, it will be understood by one of ordinary skill in the art that variations in form and detail may be made therein without departing from the spirit and scope of the claims.

We claim:

1. An antenna radiating element, comprising:

an antenna configured to transmit a signal having one or more measurable characteristics; and a shroud surrounding the antenna and configured to change the one or more measurable characteristics, the shroud including a hollow body tapered from one end to the other end, and one or more members attached to an exterior of the hollow body.

2. The antenna radiating element of claim 1, wherein the antenna is a dipole antenna.

3. The antenna radiating element of claim 1, wherein the one or more measurable characteristics is beam width.

4. The antenna radiating element of claim 1, wherein the hollow body is constructed of one of a conductive material, a non-conductive material plated with a conductive material and a non-conductive material loaded with a conductive material.

5. The antenna radiating element of claim 1, wherein the one or more members are constructed of one of a conductive material, a non-conductive material plated with a conductive material and a non-conductive material loaded with a conductive material.

6. The antenna radiating element of claim 5, wherein the one or more members are L shaped, and one portion of the L shaped member extends from an outer surface of the hollow body.

7. The antenna radiating element of claim 6, wherein the one portion is a perpendicular portion extending perpendicularly from the outer surface of the hollow body, and another portion of the L shaped member is a parallel portion extending down from the perpendicular portion and parallel to the outer surface of the hollow body.

8. The antenna radiating element of claim 7, wherein the perpendicular portion and the parallel portion include at least one unequal dimension from one another.

9. The antenna radiating element of claim 7, wherein the perpendicular portion and the parallel portion include at least one shape different from one another.

10. The antenna radiating element of claim 7, wherein at least one of the perpendicular portion and the parallel portion include a surface pattern.

11. The antenna radiating element of claim 10, wherein the surface pattern extends through the at least one of the perpendicular portion and the parallel portion.

12. The antenna radiating element of claim 1, wherein the hollow body is a hollow cylinder.

13. The antenna radiating element of claim 1, wherein the hollow body has a hollow rectangular cross-section.

14. The antenna radiating element of claim 1, wherein the hollow body has a hollow polygon cross-section.

15. The antenna radiating element of claim 1, wherein the antenna is a single band antenna.

16. The antenna radiating element of claim 1, wherein the one or more measurable characteristics is isolation.

17. The antenna radiating element of claim 1, wherein the one or more measurable characteristics is cross polarization.

18. A method of manufacturing an antenna shroud, the method comprising:

modeling an antenna, the model including one or more measurable signal characteristics;

modeling the shroud to change the one or more measurable signaling characteristics; and manufacturing the shroud based on the modeled shroud, the manufacturing including, constructing a hollow body tapered from one end to the other end, constructing the one or more members, and attaching the one or more members such that one portion of the one or more members extends from an outer surface of the hollow body.

19. A method of changing signal characteristics of an antenna, the method comprising:

installing a shroud over an antenna, wherein the shroud changes one or more measurable signal characteristics associated with the antenna, the shroud including a hollow body tapered from one end to the other end, and at least one member attached to an exterior of the hollow body.

20. The method of claim 19, wherein the one or more signal measurable characteristics are at least one of beam width, isolation and cross polarization, and the one or more signal characteristics are measured before and after the shroud is installed.

* * * * *